US009982914B2

(12) United States Patent
Hofbauer

(10) Patent No.: US 9,982,914 B2
(45) Date of Patent: May 29, 2018

(54) COMBINATION HEAT EXCHANGER AND BURNER

(71) Applicant: ThermoLift, Inc., Stony Brook, NY (US)

(72) Inventor: Peter Hofbauer, West Bloomfield, MI (US)

(73) Assignee: ThermoLift, Inc.

( * ) Notice: Subject to any disclaimer, the term of this patent is extended or adjusted under 35 U.S.C. 154(b) by 98 days.

(21) Appl. No.: 14/648,813

(22) PCT Filed: Dec. 4, 2013

(86) PCT No.: PCT/US2013/073087
§ 371 (c)(1),
(2) Date: Jun. 1, 2015

(87) PCT Pub. No.: WO2014/089191
PCT Pub. Date: Jun. 12, 2014

(65) Prior Publication Data

US 2017/0010021 A1 Jan. 12, 2017

(51) Int. Cl.

| | |
|---|---|
| ***F22B 15/00*** | (2006.01) |
| ***F24H 9/20*** | (2006.01) |
| ***F23N 5/12*** | (2006.01) |
| ***F24H 1/43*** | (2006.01) |
| ***F23M 9/10*** | (2006.01) |

(Continued)

(52) U.S. Cl.
CPC ..... *F24H 9/2035* (2013.01); *F23M 9/10* (2013.01); *F23N 1/082* (2013.01); *F23N 5/12* (2013.01); *F24H 1/145* (2013.01); *F24H 1/43* (2013.01); *F28D 7/028* (2013.01); *F28D 7/04* (2013.01); *F28D 21/0003* (2013.01); *F28D 21/0007* (2013.01); *F28F 1/022* (2013.01); *F28F 1/16* (2013.01); *F24H 2210/00* (2013.01)

(58) Field of Classification Search
CPC ..... F22B 21/24; F22B 21/26; F22B 21/28; F22B 17/04; F24H 1/165; F24H 1/40; F28F 1/36
See application file for complete search history.

(56) References Cited

U.S. PATENT DOCUMENTS 3,809,061 A * 5/1974 Gerstmann ..... F22B 27/08 122/18.4
3,881,111 A 4/1975 Stephens
(Continued)

FOREIGN PATENT DOCUMENTS

DE 4218754 A1 12/1993
DE 29715119 U1 11/1997
(Continued)

*Primary Examiner* — Gregory A Wilson
(74) *Attorney, Agent, or Firm* — Diana D. Brehob

(57) ABSTRACT

It is common in heating systems, such as in a hot water heater for there to be a combustor with the exhaust gases from the combustor provided to a heat exchanger to heat up the water. Disclosed herein is an integrated heat exchanger and burner assembly in which the combustion occurs proximate the surface of the heat exchanger. Such a system may include at least one tube that is coiled into a number of turns, that is a tube coil with the at least one tube having an inlet and an outlet and the distance between adjacent turns is less than a predetermined distance, i.e. a the quench distance.

19 Claims, 2 Drawing Sheets

(51) Int. Cl.

| | |
|---|---|
| ***F23N 1/08*** | (2006.01) |
| ***F28D 7/02*** | (2006.01) |
| ***F28D 7/04*** | (2006.01) |
| ***F28D 21/00*** | (2006.01) |
| ***F28F 1/02*** | (2006.01) |
| ***F28F 1/16*** | (2006.01) |
| ***F24H 1/14*** | (2006.01) |

(56) References Cited

U.S. PATENT DOCUMENTS

| | | | | |
|---|---|---|---|---|
| 4,798,240 | A | 1/1989 | Gerstmann | |
| 5,365,887 | A | 11/1994 | Fenn | |
| 5,899,686 | A | 5/1999 | Carbone | |
| 6,035,810 | A | 3/2000 | Movassaghi | |
| RE36,743 | E | 6/2000 | Ripka | |
| 7,013,842 | B2 * | 3/2006 | Loving | F22B 21/26 122/169 |
| 7,631,640 | B2 | 12/2009 | Hofbauer | |
| 8,347,826 | B2 * | 1/2013 | Amada | F24H 1/43 122/235.23 |
| 2006/0016401 | A1 * | 1/2006 | Loving | F22B 21/26 122/250 R |
| 2011/0041781 | A1 | 2/2011 | Delvasigamani | |
| 2016/0282011 | A1 * | 9/2016 | Umakoshi | F24H 1/165 |

FOREIGN PATENT DOCUMENTS

| | | | |
|---|---|---|---|
| EP | 2424227 | A2 | 3/2012 |
| FR | 93 99487 | A1 | 7/1994 |
| JP | S572932 | A | 1/1982 |
| JP | 2000-055337 | A | 2/2000 |
| WO | 2004031651 | A2 | 4/2004 |
| WO | 2009061087 | | 5/2009 |
| WO | 2011-009872 | A1 | 1/2011 |

* cited by examiner

COMBINATION HEAT EXCHANGER AND BURNER

FIELD

The present disclosure relates to a structure that can serve as both a burner and a heat exchanger.

BACKGROUND

It is common in heating systems, such as in a hot water heater for there to be a combustor with the exhaust gases from the combustor provided to a heat exchanger to heat up the water. It would be desirable to reduce the number of components to provide a compact efficient system.

SUMMARY

An assembly is disclosed that has an integrated heat exchange and burner that includes: at least one tube that is coiled into a number of turns, that is a tube coil, wherein the at least one tube has an inlet and an outlet and the distance between adjacent turns is less than a predetermined distance, an entrance housing coupled to the tube coil and located on a first side (or upstream side) of the tube coil. In one alternative, the tube coil is housed in the entrance housing. A fuel supply is coupled to the entrance housing; an air supply is coupled to the entrance housing, and an ignitor is proximate a second side (or downstream side) of the tube coil.

The tube coil forms a spiral with the turns located substantially in a plane. In alternative embodiments, the tube coil may be from a cone, a hemisphere, or any suitable shape. The assembly may also include an exit housing coupled to the entrance housing and located on the downstream side of the tube coil. The ignitor is mounted in the exit housing.

In one embodiment, the tube coil forms a helix in which the diameter of the helix increases monotonically from one end to the other.

The cross section of the tube is substantially rectangular, or more generally terms quadrilateral.

The heat exchanger/burner assembly also includes: a thermocouple disposed in the exit housing, a valve in the fuel supply, and an electronic control unit (ECU) electronically coupled to the thermocouple and the valve. The ECU commands a position to the valve based at least on a signal from the thermocouple.

The assembly may further include a user input electronically coupled to the ECU. The command by the ECU to the valve is further based on the user input. A pressurized water supply may be coupled to the inlet of the tube coil and fuel and air are provided to the upstream side of the tube coil.

In some embodiments, the tube has at least one internal brace.

In cross section, the tube is substantially rectangular with a long side of the tube parallel to a direction of flow.

In some embodiments, the tube has flame holders that extend away from the tube in a downstream direction.

The at least one tube contains a plurality of tubes coiled into a spiral in which a distance between adjacent coils less than the predetermined distance and each individual tube has an inlet and an outlet.

In some embodiments, an ion sensor is disposed in the exit housing and electronically coupled to the ECU. The ECU commands the fuel valve to close when a based on a signal from the ion sensor indicates the fuel is unoxidized.

Prior systems have a burner and a heat exchanger. Efficiency of an integrated system is improved by having the heat exchanger serve as the burner, i.e., having the combustion stabilized on the surface of the heat exchanger. Furthermore, the integrated system is more compact.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations whether or not explicitly described or illustrated.

Figure 1:
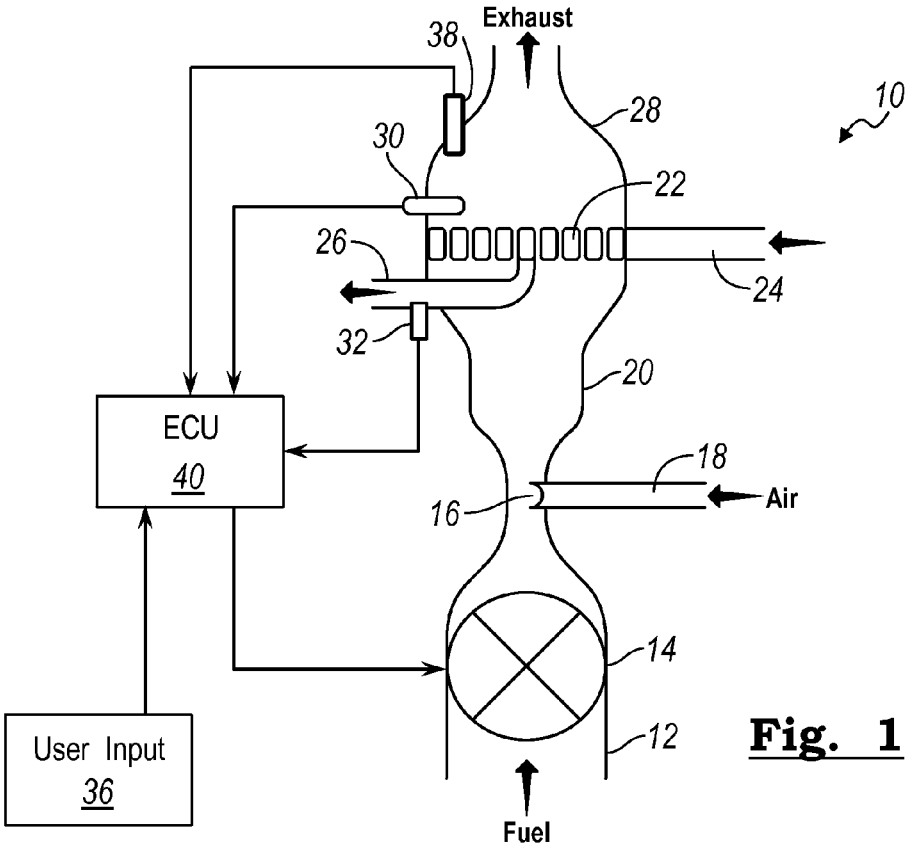
FIG. 1 is an illustration of an integrated heat exchanger and burner assembly according to an embodiment of the present disclosure.

A combination heat exchanger and burner assembly 10 is shown schematically in FIG. 1. Fuel is supplied to assembly 10 and metered through valve 14. Air supply 18 is coupled to the throat of venturi 16. An entrance housing 20 is coupled to a tube coil 22. In the embodiment of FIG. 1, a cross section of tube coil 22 is shown in which a single tube is used. In other embodiments, a plurality of tubes can be wounded together with the wrap of one tube adjacent to the wrap of the other tube. The gap between any two adjacent coils or between the wall of the housing and the outer coil is at most a predetermined distance with the predetermined distance being less than a quench distance. Tube coil 22 has an inlet 24 and an outlet 26. An exit housing 28 is also coupled to tube coil 22. An ignitor 30 is provided at the downstream side of the tube coil 22.

Quench distance is commonly defined as a width or a diameter through which a flame will not propagate. The quench distance depends on the geometry, (e.g., whether a slot or a tube) and the stoichiometry of the fuel-air mixture, primarily, with other secondary effects such as fuel type, the material around the gap, and temperature. For the present situation, the quench distance is determined for the operating condition anticipated which yields the smallest quench distance. This distance, for typical hydrocarbon fuels is expected to be on the order of 0.5 mm. The gaps between adjacent tubes is spaced to be less than the determined quench distance, or smaller, throughout heat exchanger (coil tube 22). A combustible mixture may exist in entrance housing 20. But, without an ignition source, oxidation of the fuel fails to be initiated. Exit housing 28 has an ignitor 30 so that oxidation of the fuel occurs in exit housing 28. If openings in tube coil 22 that fluidly couple entrance housing 20 to exit housing 28 are smaller than the quench distance, the combustion in exit housing 28 does not flash back into inlet housing 20. The amount of fuel and air provided to inlet housing 20 by electronic control unit (ECU) 40 providing a signal to valve 14. ECU 40 may be provided a user input 36 and or from a thermocouple 32 disposed in outlet 26.

An ion sensor 38 is disposed in exit housing 28. Combustion or oxidation of hydrocarbons yields ions. Thus, when oxidation of the fuel is expected, a signal at ion sensor is registered. However, if the fuel remains unoxidized through the burner, few or no ions are expected and the signal at ion sensor 38 is negligible. A signal from ion sensor 38 is provided to ECU 40. When the signal indicates that the fuel is not being oxidized, ECU 40 commands valve 14 to close to prevent unwanted leakage of unburned fuel.

Figure 2:
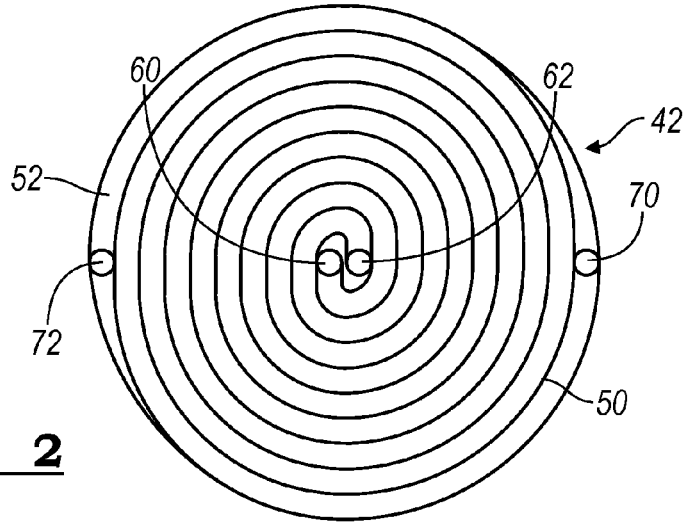
FIG. 2 is a plan view of a heat exchanger that has two tubes formed in a spiral.

In FIG. 2, a plan view of an alternative tube coil 42 has two tubes 50 and 52 that are intertwined into a spiral. Tube 50 has an inlet 60 and outlet 70 or alternatively outlet 60 and inlet 70. Similarly, tube 52 has an inlet 62 and outlet 72 or alternatively outlet 70 and inlet 72. The distance between adjacent tubes is less than a quench distance. Providing multiple tubes allows greater flow area for the fluid flowing on the inside of the tubes, thereby lowering flow resistance.

Figure 3:
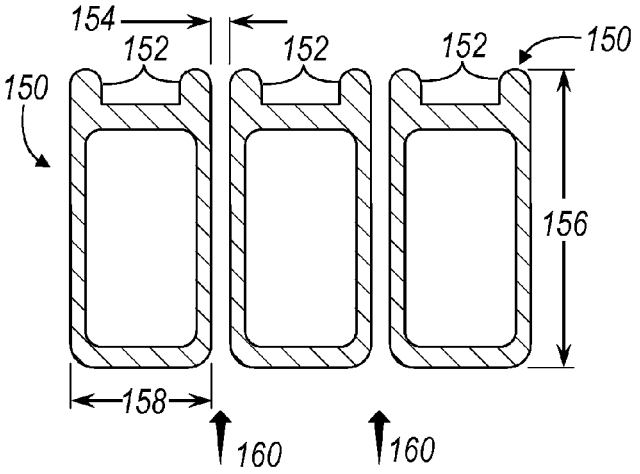
FIG. 3 is a cross section of three adjacent sections of a tube having flame holders.

In FIG. 3, a cross section of three adjacent tubes 150 is shown. The tubes have flame holders 152, i.e., tabs on a downstream side. Flame holders 152 can be useful to provide a hot spot to maintain combustion even at low fuel/air input rates. The length 156 of the tubes 150 in the direction of flow 160 is greater than the width 158 of the tubes. The distance 154 between adjacent tubes is less than a quench distance. Fuel and air is shown to flow 160 toward tubes 150.

Figure 4:
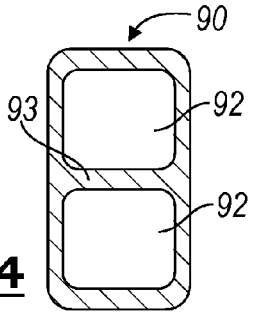
FIGS. 4 and 5 show cross sections of tubes having internal braces.
Figure 5:
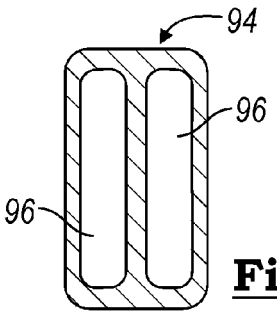

The cross section of tubes 150 may not be as stiff as desired to resist deformation under pressure particularly at operational temperatures in which tubes 150 are serving as combustion stabilizers. An alternative cross-sectional shape is shown in FIG. 4 in which a tube 90 has two opening 92 with a brace 93 between the two openings. In yet another alternative shown in FIG. 5, in which a tube 94 has two openings 96 with a vertical brace. Other alternatives with more than two openings are also contemplated. Such tube shapes as those shown in FIGS. 4 and 5 may be formed via extrusion.

Figure 6:
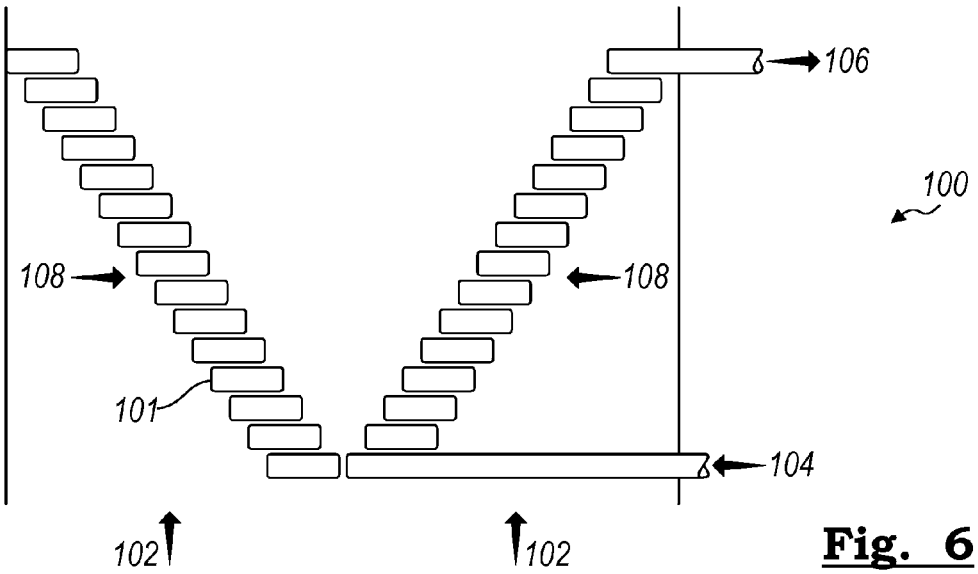
FIG. 6 is a cross-sectional illustration of a heat exchanger/burner according to an embodiment of the present disclosure

Tube coil 22 in FIG. 1 is shown as lying in a plane. An alternative configuration of a heat exchanger and burner assembly 100 is shown in which a tube coil 101 is in a helix in which the diameter of each turn increases monotonically from bottom to top is shown in FIG. 6. Fuel and air is provided in direction 102 to tube coil 101. Water is provided at inlet 104 and exits at outlet 106. Fuel and air goes through tube coil 101 at openings between successive turns such as shown by arrows 108.

While the best mode has been described in detail with respect to particular embodiments, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments described herein that are characterized as less desirable than other embodiments or prior art implementations with respect to one or more characteristics are not outside the scope of the disclosure and may be desirable for particular applications.

I claim:

1. An integrated heat exchanger and burner assembly, comprising:
- at least one tube that is coiled into a number of turns, that is a tube coil, wherein the at least one tube has an inlet and an outlet and the distance between adjacent turns is less than a quench distance;
- an entrance housing in which the tube coil is housed with the entrance housing located on the upstream side of the tube coil;
- a fuel supply coupled to the entrance housing;
- an air supply coupled to the entrance housing;
- an exit housing coupled to the entrance housing wherein fuel and air supplied to the entrance housing pass through gaps adjacent to turns of the tube coil to exit through the exit housing; and
- an ignitor mounted in the exit housing.

2. The assembly of claim 1 wherein the tube coil forms a spiral with the turns located substantially in a plane.

3. The assembly of claim 1 wherein the tube coil forms a helix in which the diameter of the helix increases monotonically from one end to the other.

4. The assembly of claim 1 wherein the cross section of the tube forms a quadrilateral.

5. The assembly of claim 1, further comprising:
- an exit housing coupled to the entrance housing;
- a thermocouple disposed in the exit housing;
- a valve in the fuel supply; and
- an electronic control unit (ECU) electronically coupled to the thermocouple and the valve wherein the ECU commands a position to the valve based at least on a signal from the thermocouple.

6. The assembly of claim 1, further comprising: a user input electronically coupled to the ECU wherein the command by the ECU to the valve is further based on the user input.

7. The assembly of claim 1 wherein a pressurized water supply is coupled to the inlet of the tube coil.

8. The assembly of claim 1 wherein fuel and air are provided to the upstream side of the tube coil.

9. The assembly of claim 1 wherein the tube has at least one internal brace.

10. The assembly of claim 1 wherein in cross section, the tube is substantially rectangular with a long side of the tube parallel to a direction of flow.

11. The assembly of claim 1 wherein the tube has flame holders that extend away from the tube in a downstream direction.

12. The assembly of claim 1 wherein the at least one tube contains a plurality of tubes coiled into a spiral in which a distance between adjacent coils less than the quench distance and each individual tube has an inlet and an outlet.

13. The assembly of claim 1, further comprising:
- an ion sensor disposed in the exit housing;
- a valve disposed in the fuel supply;
- an electronic control unit (ECU) electronically coupled to the ion sensor and the valve wherein the ECU commands the valve to close when a based on a signal from the ion sensor indicates the fuel is unoxidized.

14. A heater, comprising:
- at least one tube that is coiled into a number of turns, that is a tube coil, wherein the at least one tube has an inlet and an outlet and the distance between adjacent turns is less than a quench distance;

an entrance housing in which the tube coil is housed wherein the tube coil has an upstream side receiving fuel and air and a downstream side;

a fuel supply coupled to the entrance housing;

an air supply coupled to the entrance housing;

an ignitor proximate the downstream side of the tube coil; and an exit housing coupled to the entrance housing.

15. The heater of claim 14 wherein the at least one tube comprises a first tube and a second tube with turns of the first tube adjacent to turns of the second tube and turns of the second tube adjacent to turns of the first tube.

16. The heater of claim 14 wherein the at least one tube has a substantially quadrilateral cross section.

17. The heater of claim 14, further comprising:

a thermocouple proximate the downstream side of the tube coil;

a valve disposed in the fuel supply; and an electronic control unit (ECU) electronically coupled to the thermocouple and the valve wherein the ECU commands a position to the valve based at least on a signal from the thermocouple.

18. The heater of claim 14, further comprising:

an ion sensor proximate the downstream side of the tube coil;

a valve disposed in the fuel supply; and an electronic control unit (ECU) electronically coupled to the ion sensor and the valve wherein the ECU commands the valve to close based on a signal from the ion sensor.

19. The heater of claim 14, further comprising: a pressurized fluid supply is coupled to the inlet of the tube coil.

* * * * *